United States Patent [19]

Duwel et al.

[11] 4,347,506

[45] Aug. 31, 1982

[54] ELECTRONIC POSTAGE METER HAVING CHECK DATE WARNING WITH CONTROL FOR OVERRIDING THE CHECK DATE WARNING

[75] Inventors: Edward C. Duwel, Trumbull, Conn.; John H. Soderberg, Monroe, N.Y.

[73] Assignee: Pitney Bowes, Inc., Stamford, Conn.

[21] Appl. No.: 237,807

[22] Filed: Feb. 24, 1981

[51] Int. Cl.[3] ..... G08B 21/00

[52] U.S. Cl. ..... 340/679; 340/545; 340/870.09; 364/900

[58] Field of Search ..... 340/679, 545, 870.09; 364/900

[56] References Cited

U.S. PATENT DOCUMENTS

| | | | |
|---|---|---|---|
| 2,934,009 | 4/1960 | Bach et al. | 101/235 |
| 3,978,457 | 8/1976 | Check, Jr. et al. | 364/200 |
| 4,050,374 | 9/1977 | Check, Jr. | 101/91 |
| 4,097,923 | 6/1978 | Eckert, Jr. et al. | 364/900 |

*Primary Examiner*—Glen R. Swann, III

*Attorney, Agent, or Firm*—David E. Pitchenik; William D. Soltow, Jr.; Albert W. Scribner

[57] ABSTRACT

An electronic postal meter is provided with a date setter having an access door coupled to a switch. The position of the switch is signalled to the internal computer, in order to effect a warning indication if the access or dater door is open. The computer further inhibits operation of the postal meter upon the initial application of power to the postal meter, until the dater door has been opened and closed at least once. Means coupled to the computer are provided for enabling operation of the meter when the dater door is closed. This allows the meter to be enabled for operation without first opening and then closing the dater door each time the meter is turned on. The enabling means may be located remote from the meter and may comprise a remote keyboard having a check date warning override key.

12 Claims, 10 Drawing Figures

ELECTRONIC POSTAGE METER HAVING CHECK DATE WARNING WITH CONTROL FOR OVERRIDING THE CHECK DATE WARNING

FIELD OF THE INVENTION

This invention relates to electronic postage meters, and is more particularly directed to an electronic postage meter of the type having a mechanism to print the date mail is franked by the meter.

BACKGROUND OF THE INVENTION

Devices of the above type are generally known, and are discussed, for example, in U.S. Pat. No. 3,978,457. Reference is also made to U.S. Application Ser. No. 89,422 filed Oct. 30, 1979 for Alton Brooks Eckert and Edward Charles Duwell and entitled ELECTRONIC POSTAGE METER HAVING CHECK DATE WARNING, now U.S. Pat. No. 4,283,721, issued Aug. 11, 1981. This reference discloses a system for a postal meter including keyboard for the manual introduction of data corresponding to the postage to be printed.

Postal meters are generally provided with settable printing devices, including means for setting the date the postage is to be printed. It is frequently important to be able to show, with a reasonable degree of certainty, when an envelope was mailed. In the use of postal meters, however, the desired accuracy is not always achieved, since on occasion the operator forgets to set the daters of the printing device.

Electronic postal meters of known type, such as disclosed in the above U.S. patent, have provided warnings to indicate that the date should be checked whenever the meter is turned on. The mere warning, for example by the flashing of a light, however, is no assurance that the dater will in fact be checked or brought up to date, and hence in most meters the setting of the date was the responsibility of the operator.

SUMMARY OF THE INVENTION

In accordance with the present invention, however, the warning of the open dater door is provided, as in the past, for preventing operation of the equipment while the dater door is open, to avoid injury to personnel, and in addition, the equipment is prevented from operation at the initialization state, even though the dater door is closed, until it has been opened at least once.

For this purpose, then, the dater door switch is directly connected to the computing system of the meter so that in addition to blocking operation of the meter when the door is open, the meter will not be operable upon the initial application of power to the system, until an opening and closing of the door has been effected.

When the power has been turned on, and a warning is given to the operator that the dater door should be checked, it is assumed that the operator, in checking the dater door, will also remember to set the date properly if this had not been previously done. In accordance with the present invention, the operator must now therefore, take a positive step in the operation of the meter. Means coupled to the computing system are provided for enabling operation of the meter when the dater door is closed. This allows the meter to be enabled for operation without first opening and then closing the dater door each time the meter is turned on. The means for enabling may be located remote from the meter and may comprise a remote keyboard having a check date override key. The enabling means are particularly desireable in those applications where the meter is mounted on a base of the type having a hood or other arrangement where access to the meter itself is difficult or time consuming and/or where the meter may be turned on and off more than once during the day.

BRIEF DESCRIPTION OF THE DRAWINGS

In order that the invention will be more clearly understood, it will now be disclosed in greater detail with reference to the accompanying drawings, wherein.

DETAILED DESCRIPTION

Figure 1:
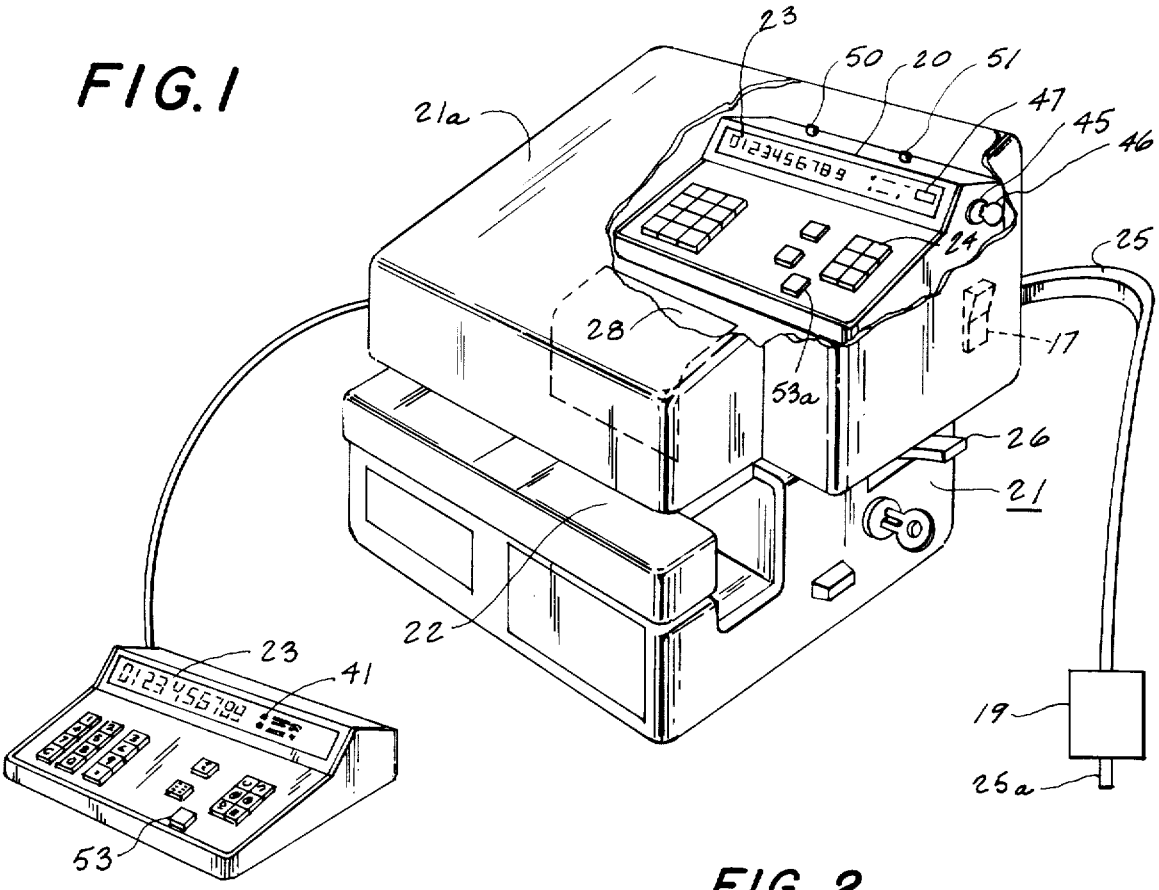
FIG. 1 is a simplified perspective view of a postal meter which may incorporate the system of the present invention and includes a remote keyboard and display and dual power switches.

Referring now to the drawings, and more in particular to FIG. 1, therein is illustrated a postage meter 20 removably affixed to a base 21, in accordance with one embodiment of the invention. In this arrangement, a slot 22 is provided between the postage meter 20 and the base 21 at the forward edge thereof, for receiving envelopes or the like and the printing of postage thereon. The postage meter is provided with a remote keyboard and display having an electronic display panel 23, as well as a control panel 24 which may be organized in a manner to be disclosed in the following paragraphs. The apparatus may be energized by way of a first power switch 17, a supply cable 25 and a second remote power switch 19 and a further supply cable **25*a*** to a source of operating power, not shown.

The postage meter 20 illustrated in FIG. 1 may be of the type that is removable from the base 21, and the base 21 may be of the type disclosed, for example, in U.S. Pat. No. 2,934,009, Bach, et al, incorporating a mechanical drive for operation of the printing mechanism in the meter 20. The separability of the meter and base renders the electronic meter compatible with conventional driving units, simplifies servicing of the device and, if necessary, simplifies transport of the meter for recharging if remote charging capabilities are not employed.

For soundproofing, the meter 20 is enclosed by a hood 21*a* which is part of the base. The hood 21*a* encloses both the power switch 17 and a dater door 28 discussed in greater detail hereafter. The hood is pivotably mounted to the base 21 and is opened to gain access to the dater door 28 and the meter power switch 17. Although the meter may be turned on and off many times each day, the date need only be checked to properly set the date only once when the meter is first turned on.

Figure 2:
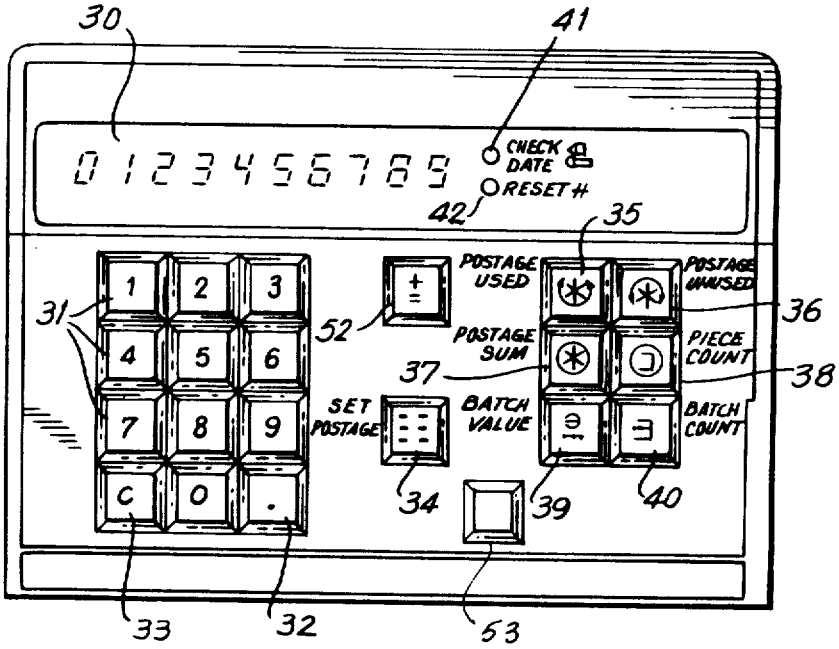
FIG. 2 is an enlarged view of the remote keyboard and display panel of the postal meter of FIG. 1.

The remote keyboard and display panel for the postage meter is more clearly illustrated in FIG. 2, wherein it is seen that the meter is provided with a numeric display 30, for example, a conventional multiplexed seven-segment LED or LCD display. In addition, the keyboard is provided with numeric setting keys 31 and a decimal key 32 operative therewith, for setting the meter to print a desired amount of postage, the amount normally being displayed on the display 30. A clear key 33 may also be provided to clear the display amount in the event, for example, of an erroneous entry. When the displayed amount has been set to the desired value, depression of a set postage key 34 effects setting of the print wheels for setting postage.

The panel may further be provided with a series of keys enabling the selective display of other values on the display 30. For example, depression of a key 35 may enable the display of the contents of an ascending register, i.e., the postage used by the meter, and depression of a key 36 may enable display of the contents of a descending register in the meter, i.e., the postage for which the meter is still charged. Further keys 37–40 may enable display in conventional manner of other specific specialized values as control or postage sum, piece count, batch value, and batch count, respectively. The batch value and batch count registers can be cleared by simultaneous depression of either batch value key or batch count key and the clear key C. The panel additionally is provided with an LED 41 which will be lit upon each application of power to the meter, as is conventionally done at the beginning of a day, to indicate that the dater has not been set or that the dater door is open. A further LED display 42 may be provided and interconnected to be lit if necessary to reset the trip mechanism in the base before operation is to continue.

In order to provide recharging of the meter, for example, by way of the remote keyboard, the meter itself may be provided with a key slot 45 illustrated in FIG. 1, in which a key may be inserted. The shaft of the lock may be visible through a window 47 on the meter to display the position of the key. Thus, in the normal setting of the key this shaft may display the message "operate" as illustrated. This arrangement may also be employed for remote meter resetting, as discussed, for example, in U.S. Pat. No. 4,097,923.

As a further feature, the meter may be provided with a service switch 50 at the rear of the meter itself for the convenience of field service personnel enabling use of the keys of the meter for different functions. Upon operation of the switch 50, the keys 35 through 40 may thereby enable the display of additional values such as the unlock value, the low postage warning amount, the meter number, diagnostic status, and the maximum settable amount. Turning the switch to an "enter combination" position, as indicated in the window 47, while entering a correct coded combination in the keyboard, enables the recharging mode of the meter to be effective. In the charging mode, which may be attained by means of an internal switch lock controlled by the key 46, an "enter amount" position as shown by this message at the window 47, may enable entry of recharging value registers of the meter by way of the keyboard. Returning the key to the operate position enables the resumption of the use of the meter for printing postage.

The service switch may be in an unsecured position in the meter, since the display of the additional values rendered possible by the use of this switch does not affect the security of the meter, and merely enables the display of further values. The fact that it is these values that are being displayed may be shown by distinctive underlining of the display, if desired, and the operation of the service switch 50 partially disables the set postage key 34. It will then not be possible to set a new value of postage in the postage meter when it is in the "service" mode and the interposer will act to block operation of the meter in the service mode. However, the set key may still be used to cause the display of the currently set value.

When the meter is in the service mode, i.e., with the switch 50 operated, and the switch 45 and key 46 activated, the entry into the keyboard of a new value and a code indicating the function of that value, will enable the resetting of the unlock value, low warning postage amount or maximum settable amount, respectively. The "unlock" value is a determined value, for example, one dollar, including and above which the operator should be careful in setting so as to avoid accidental printing of excessive amounts. For this purpose, all values including and above the unlock value require an additional step on the part of the operator, such as an additional depression of the set postage key 34. The display may be provided with a distinctive indication, for example, one horizontal bar, to indicate that the printing wheels have been set but the unlock step, i.e., the additional depression of the set postage key, has not been effected. The completion of the unlock step would be indicated by the display, for example, of three horizontal bars to indicate that the meter is enabled to be tripped, to print postage.

If the descending register does not contain sufficient funds to cover the set amount on the print wheels, the entire display may be caused to blink. On the other hand, if the value stored in the descending register is lower than the low postage warning limit, the decimal point may be caused to blink. The "maximum settable" amount, of course, cannot be exceeded in the setting of any postage.

The meter itself may also be provided with a "privileged" switch 51 that is normally held in the operate position by a seal. The operation of this switch, following the cutting of the seal, enables the recharging of the meter by post office personnel in a non-remote charging mode.

In addition, the meter is provided with one or more arithmetic function keys 52, enabling a variation of the postage setting amount, such as the addition of further values to the already displayed setting value prior to the depression of the set switch 34. This feature enables the introduction by the operator of further values, such as insurance or the like, without the necessity for manual calculation or calculation on a separate device. An additional key 53 is also provided on the remote keyboard and display panel. This key functions, as will more fully be explained hereinafter, to override the check date warning light without the need to open and close the dater door 28.

Figure 3:
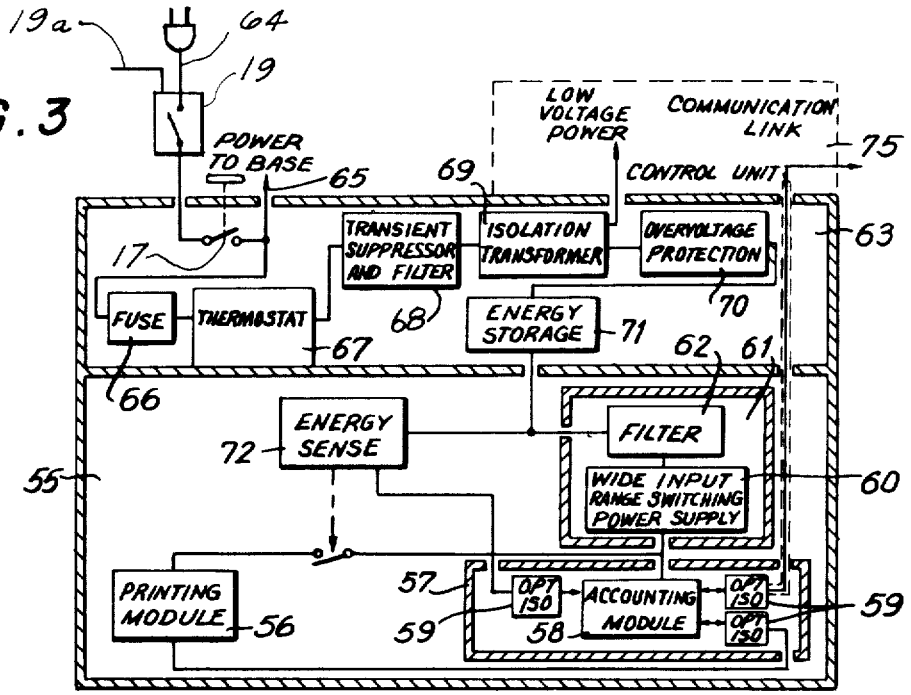
FIG. 3 is a simplified block diagram of the orientation of the elements in accordance with a preferred embodiment of the invention.

The interal components of the postage meter in accordance with the invention are preferably oriented as illustrated in FIG. 3, and include a first compartment 55 that is physically secure, i.e., as secure as is reasonably possible to avoid tampering with internal components thereof. While it may not be possible to provide 100% security in this regard, physical evidence of tampering will be evident in any event before entry can be gained. The compartment 55 encloses the printing module 56, which may include a mechanical printing assembly, and if desired, a separate microcomputer for controlling this module.

The compartment 55 also encloses a further compartment 57, which is preferably electromagnetically shielded, and encloses an accounting module 58. The accounting module is connected to external devices, i.e., external of the compartment 57, only by optical or similar isolation couplers 59 as disclosed in U.S. patent application Ser. No. 63,369 filed Aug. 3, 1979 for F. Check, and entitled ELECTRONIC POSTAL METER HAVING NOISE REJECTING INPUT-/OUTPUT CHANNEL, now U.S. Pat. No. 4,310,754, issued Jan. 12, 1982 in order to avoid damage thereto, either accidental or intentional resulting from introduction of noise, for example, excess voltages into the accounting module. Such coupling is, of course, not provided for the energy source thereof, which extends to a power supply 60 in a separate compartment 61 also within the secure compartment 55. The power supply 60 is energized by way of a filter 62 within the compartment 61, to insure the absence of any voltage variations that would adversely affect the accounting module, the power input to the compartment 61 being directed into the compartment 55 from a power supply system in a further compartment 63 that is preferably defined by the outer secure housing of the compartment 55. Thus, while it is not absolutely necessary for all the elements within the compartment 63 to be physically secure, this feature is preferred.

The power from the mains plug 64 is fed via switches 19 and 17 into the compartment 63, from where it may be fed by way of a suitable connection 65 to power the meter base. The power for the meter may be fused in the compartment 63, by means of a fuse 66, applied from the fuse to a thermostat 67 and thence to a transient suppressor and filter 68. The thermostat inhibits application of voltage to the unit in the event of excess temperatures. Further protection for the system is provided by means of an isolation transformer 69 and an over voltage cut-out device 70. The power for the meter is finally applied to an energy storage device 71, such as a large valued capacitor 71, the capacitor 71 having adequate energy storage to enable the self-protection features of the meter to operate, such as to transfer data to a nonvolatile memory, in the event of a power failure or when power is apparently failing due to actuation of either switch 17 or 19. The reduction of voltage may be sensed by a sensor 72 in the secure housing 55, with one output of the sensor being directed to the accounting module for signaling the necessity of a mode change, and another output (which can be mechanical) for inhibiting further printing module functions.

A further output of the isolation transformer 69 may be fed externally of the meter to a control unit 75, and one of the isolated outputs of the accounting module may be directed through the chamber 63 also to the control unit. The control unit 75 may thus constitute a keyboard control unit such as illustrated in FIG. 2, including the key switches, displays, etc., necessary for local operation of the device. It is thus apparent that the system of FIG. 3 orients the elements of the postal meter so that elements which are less critical to the security of the postal meter system are provided with successively lower levels of physical and electrical security.

Figure 4:
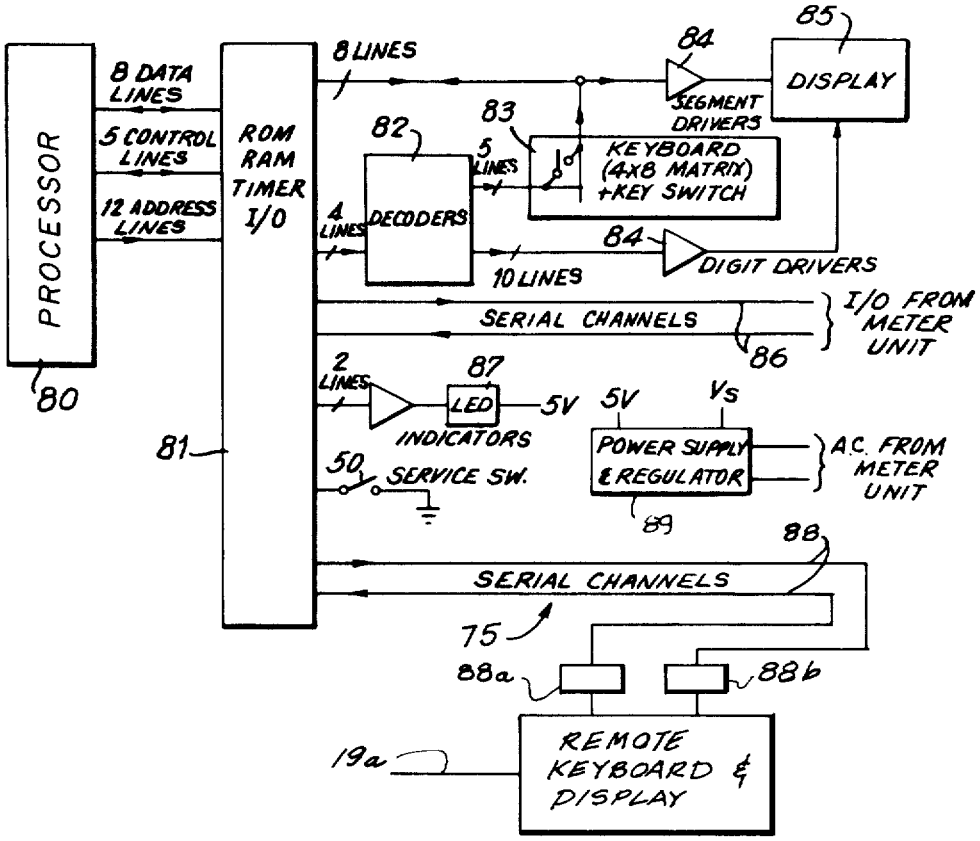
FIG. 4 is a simplified diagram of the circuitry of a control unit for a postal meter in accordance with the invention with the series I/O channel connected to the remote keyboard and display.

A preferred embodiment of a control unit 75 on the meter itself is illustrated in FIG. 4. This unit, for versatility in design, as well as for minimizing the noncritical elements that must be isolated in the physically secure housing, preferably incorporates a central processing unit 80, for example, of the 6500 series, and connected by way of conventional data lines, control lines and address lines to a multipurpose conventional RAM/-ROM I/O timer circuit 81 incorporating read-only memories, random access memories, timing control elements and input/output interface hardware. By the use of suitable decoders 82, the keyboard 83 may thereby be scanned in the conventional fashion, and by the use of suitable drivers 84 the visual display 85 may be energized, preferably in a multiplexing mode according to conventional practice. The data relating to the depression of any of the keys of the panel may thereby be communicated to the processing unit 80, for the development of a serial input/output on the lines 86 for communication with the accounting module 58 within the secure housing 55. The processor 80 and circuit 81 are responsive to the requirement for operator interventions to recock the trigger mechanism in the base, and the failure to open or close the dater door 28 (FIG. 1) following application of power to the unit, to energize selectively an indicator LED 87 corresponding to the indicators 42 and 41, respectively, of FIG. 2. The service switch 50 may also be connected to the circuit 81. The remote keyboard and display is coupled to the control unit by way of further input/output lines 88, preferably serial communication paths which may be suitably isolated by opto isolators **88*a* and 88*b*. The control unit 75 may comprise an internal power supply and regulator 89 connected to receive power from the postage meter low voltage power as shown in FIG. 3. The remote keyboard and display may be energized by power obtained from switch 19 via a separate power cord 19*a* or via line 65**, providing power to the base.

The above-discussed functions under the control of the control unit are thus functions which are not critical in the sense that loss of control or the contents of any register therein will not result in loss to the post office department, or to the user, of funds. These functions have been regulated to the control unit in order that the secure portions of the postal meter include only that programming of the system which must be secure. Additional functions that may be effected by the control unit, such as the addition of sequentially entered amounts may also be controlled by the program of the control unit, since such calculations are not critical to the security of the apparatus, and need not be effected within the physically secure portions of the postal meter. Similarly, the service resettable functions may be effected by the programming in the control unit, since these functions also are not critical to the accounting system and registers themselves. However, to retain these parameters in nonvolatile memory, retention in the accounting unit is desirable.

It will, of course, be apparent that, in a system such as shown in FIG. 4, further arithmetic keys may be provided without great difficulty, such that the postage meter may be alternately employed also as a calculator.

Alternatively, the central processing unit and its control circuit may be augmented by a calculator chip or the like, connected to the keyboard and display for performing arithmetic functions.

While the control unit of FIG. 4, including all of the functions of the remote keyboard and display panel shown in FIG. 2 is preferably disposed directly on the postage meter to form a part thereof, so that the meter can be used as a complete unit with keyboard and display, it will be apparent that this portion of this system may be physically separate therefrom, or separable therefrom, whereby the postage meter itself may incorporate only the elements that are required to be physically secure. This type arrangement may be particularly desireable where the meter is mounted on a base having a hood or other arrangement where access to the meter itself is difficult or other arrangement where access to the meter itself is difficult or time consuming.

Since monetary information and control is prevalent in the serial communication employed in the system, a high degree of integrity is mandatory. For this purpose, the system is designed, in the serial transmission communication sections, such that a transmitted bit is returned or "echoed" by the receiver thereof for checking purposes. If the transmitter thereby receives all of the echoed signals satisfactorily, it may issue a "no error" pulse, thereby informing the receiver of the information that the received information is valid.

Figure 5:
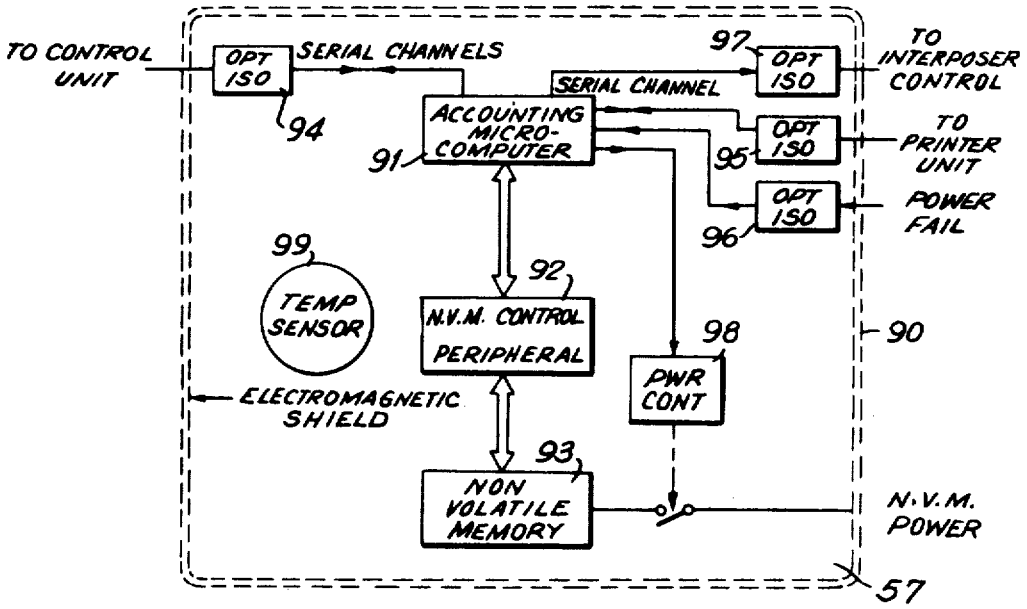
FIG. 5 is a simplified diagram of a circuit for the accounting system of a postal meter in accordance with the invention.

The circuit arrangement of the accounting compartment is shown in somewhat greater detail in FIG. 5, wherein the walls 90 of the compartment are illustrated as preferably forming an electromagnetic shield. The circuits include an accounting microcomputer 91 having a nonvolatile memory control 92 coupled thereto. The nonvolatile memory control controls the application of stored data between a volatile memory, which may form a part of the accounting microcomputer 91 and a nonvolatile memory 93. The volatile memories, such as random access memories, may function as working ascending registers, working descending registers, and the like. The accounting microcomputer also includes read-only memory control for the necessary accounting routines, as well as control routines. This unit may, in addition, incorporate serial interfaces, to enable its interfacing with the printing and control modules. The microcomputer may, for example, comprise the 8048 series microcomputer from Intel Corporation, Santa Clara, Calif., with a control circuit in a manner similar to that described above with respect to the control unit 75. In order to avoid damage to the accounting module by electric surges applied accidentally or intentionally, and to eliminate electrical noise induced via groundloops, the accounting microcomputer communicates with the devices external of the compartment 57 by suitable isolators that are not capable of applying voltage surges to the microcomputer. These isolators may, for example, be in the form of opto-electronic couplers, and are also preferably arranged so as to be inaccessible from the exterior of the postal meter. One isolator unit 94 may be provided for the two-way communication path with the control unit. A further isolator arrangement 95 may be provided for the two-way communication with the printer unit, i.e., the printing module 56 of FIG. 3, in particular, the microprocessor circuit thereof. A still further isolator 96 may be provided for applying the power sensing signals to the microcomputer 91. In addition, an isolator 97 may be provided for controlling an interposer (not shown) in the printing module, for example, for mechanically blocking functions of the printer. Such a system is disclosed, for example, in Application Ser. No. 024,812, filed Mar. 28, 1979, now U.S. Pat. No. 4,253,015, entitled POSTAGE METER IMPROVEMENT, issued Feb. 24, 1981 to R. McFiggans and A. Eckert, and assigned to the assignee of the present invention, the disclosure of which is specifically incorporated herein by reference.

The nonvolatile memory 93, at the present state of the art is preferably in the form of an MNOS memory, which does not require a back-up power source. This memory may, however, alternatively be formed of elements which do require a power back-up, in which case a power control circuit may be employed to apply back-up power thereto external from the compartment 57. The purpose of the power control circuit 98 is to provide power to the MNOS memory for the purpose of effecting its data transfer operation, essentially during power up and power down. The program of the microcomputing unit 91 is organized to enter the contents of the registers of the computer units into the nonvolatile memory as soon as any indication of failure of the power supply occurs, and to restore this data to the working registers upon restoration of the power. A power failure is sensed as occuring if either switch 17 or 19 is operated to turn off the meter.

The thermostat 67 in FIG. 3 cuts off power to the meter in the event of high or low temperature operation. This automatically places the meter in its power down cycle, as a result of the power cut-off.

The compartment 57 may further comprise a temperature sensor 99, with suitable circuits (not shown) coupled thereto, such as to the microcomputer, for transferring data to the nonvolatile memory in the event of excess temperatures. The system may further be operative to prevent the operation of the interposer solenoid by way of the isolator 97, in the event of excess temperatures. It will be appreciated that the interposer is controlled by the microcomputer 91 also to inhibit operation of the printer in the event that insufficient postage remains for a printing operation, or other accounting data indicates that the unit should not be operative.

While the isolators have been indicated as individual units, it is, of course, apparent that these units may incorporate multiple devices, so that two-way communication is established in the respective circuits. It is further noted that systems for the transfer of data between volatile and nonvolatile memories are well known, and are disclosed, for example, in U.S. Pat. No. 4,224,506, entitled ELECTRONIC COUNTER WITH NONVOLATILE MEMORY issued Sept. 23, 1980 to V. Coppola, E. Grisgrater and J. Lorenzo.

Figure 6:
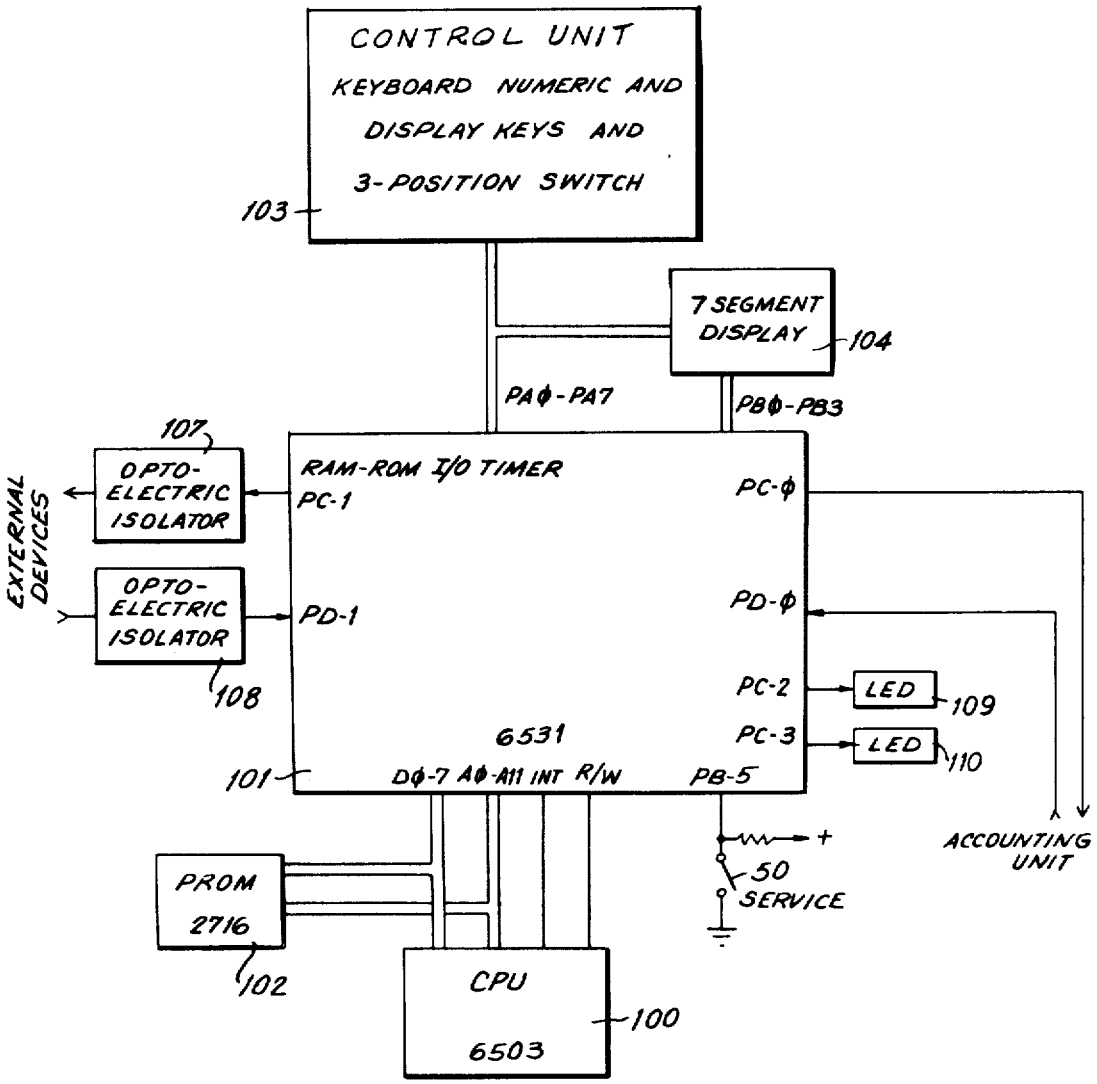
FIG. 6 is a more detailed block diagram of a preferred embodiment of the control unit for a postal meter in accordance with the invention.

Referring now to FIG. 6, therein is illustrated in greater detail a block diagram of a preferred embodiment of a control unit in accordance with the invention. In this figure the blocks have been identified by part numbers and terminals where applicable. This unit is illustrated as incorporating a type 6503 CPU 100 having its data and address lines coupled to RAM/ROM I/O timer circuit 101 as well as to a type 2716 PROM 102, the PROM 102 having stored therein the program for the control unit. Control lines, such as the interrupt line and read/write line may also be connected to the circuit 101. The circuit 101 has a plurality of ports, as will be discussed.

The control unit further incorporated the keyboard 103 including the numeric keys 31, the display keys 35–40, and the three-position switch 45 shown in FIG. 1. This unit also includes the add-through key 52 and the set postage key 34. All of these keys and switches are connected in a matrix to the circuit 101, in conventional manner, to permit the scanning of the keys and switches in accordance with the program, to detect a key or switch closure. This includes the closure of a switch 53*a* which may be provided on the control unit, similar to key 53 on the remote keyboard and display panel. This key also functions to override the check data warning light without the need to open and close the dater door. The eight-line port A, as well as four lines of port B of the circuit 101, are also connected to the seven-segment display panel 104 for multiplexed display in the conventional manner. The circuit 101 is further connected by a pair of serial ports for communication to and from the accounting unit. In addition, a pair of further serial ports enable communication to and from external devices, by way of opto-electric isolators 107 and 108, respectively. Another output port of the adaptor is connected to LED 109 for indicating on the display panel that the dater door has not been closed. A further output port is connected to an LED 110 on the display panel for indicating that the operator's intervention is required to recock the trigger mechanism on the base. Finally, another port is coupled to the service switch 50, to enable the functions of the postal meter in the service mode.

In the preferred embodiment of the invention, the program of the control unit is directed to servicing of the keyboard unit, display panel, etc., so that the control functions and storage of data are effected primarily in the accounting unit. The program thereby includes those functions necessary for the scanning of the keyboard, multiplexing of the display, formatting of signals for communication with the other units, and with external devices, etc., so that any new information may be passed on to the accounting unit.

Figure 7:
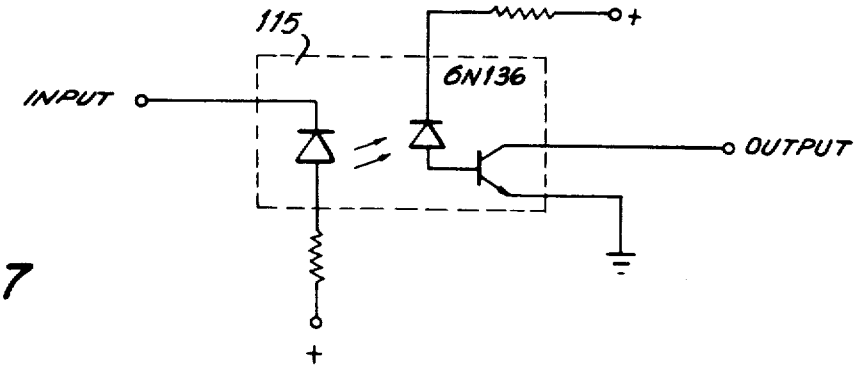
FIG. 7 is a circuit diagram of an opto-electric isolator that may be employed in the present invention.

A typical opto-electric isolator is shown in FIG. 7, this constituting primarily a conventional 6N136 device 115 including a solid state emitter for producing optical signals for reception by a photodiode, the photodiode being connected in the base circuit of a transistor amplifier.

Figure 8:
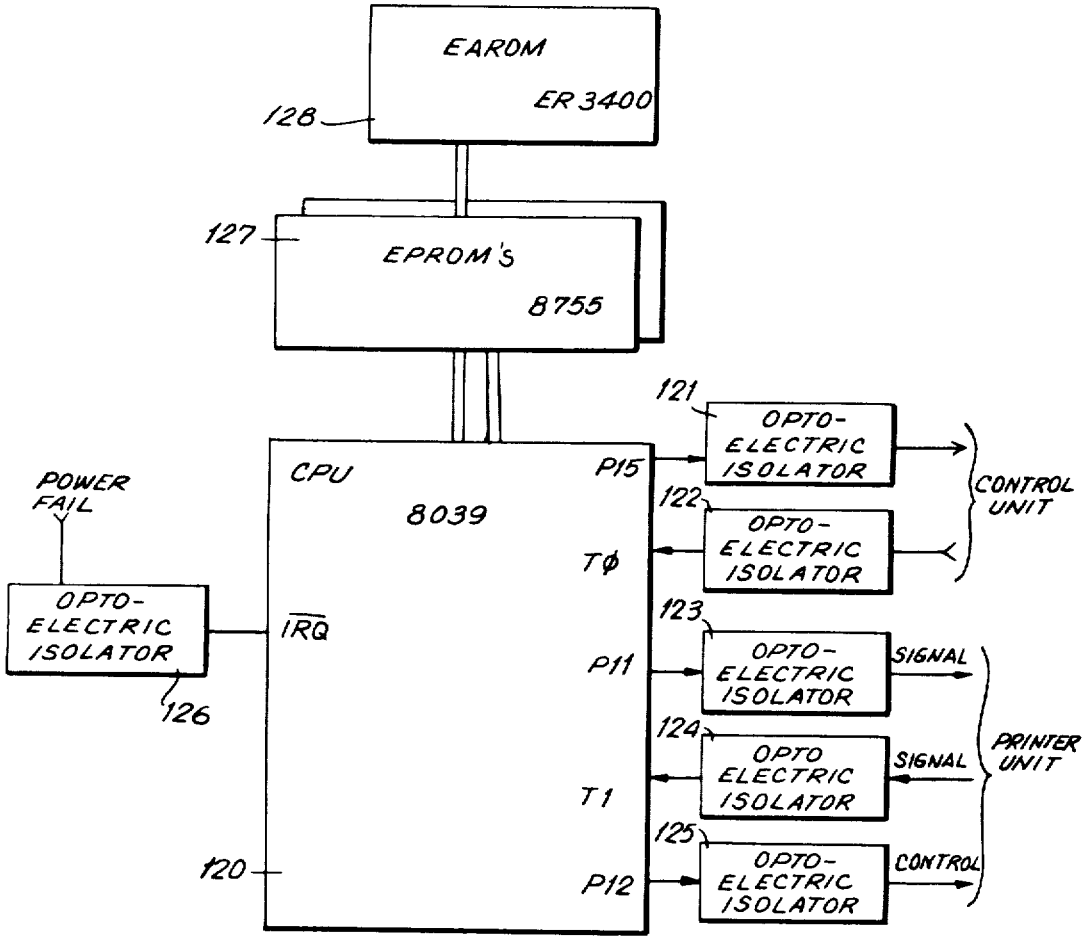
FIG. 8 is a more detailed block diagram of a preferred embodiment of an acounting unit in accordance with the invention.

A block diagram of a preferred example of the accounting unit is illustrated in FIG. 8, wherein a type 8039 CPU 120 is shown to communicate to the control unit by way of opto-electric isolators 121 and 122, and to communicate serially with the printer unity by way of opto-electric isolators 123 and 124. The opto-electric isolators 121 and 122 within the accounting unit thus may be connected directly to the corresponding leads of the control unit. The isolators 123 and 124 may be connected directly to the printer unit signal channels, since no further isolation devices are necessary for this purpose. In addition, a control opto-electric isolator 125, for controlling an interposer or the like in the printing unit may be connected to a further port of the CPU 120. Signals corresponding to a pending power failure are further fed to the interrupt port of the CPU 120, by way of opto-electric isolator 126. It is thus apparent that all signal and control to and from the accounting unit must be directed by way of opto-electric isolators, in order to insure the electrical and physical integrity of this unit. The accounting unit further includes a plurality of PROMs 127 coupled to the address and data lines of the CPU 120, each PROM 127 for example, being a E-PROM type 8755. This unit is connected to an electrically alterable read-only memory (EAROM) 128, for example, a type ER 3400, serving as a nonvolatile memory to store data at times during which the power supply to the postage meter has failed, or has been intentionally disconnected. The working memory for the accounting system, including the registers for storing all operational data, are provided in the CPU 120, this data being transferred to the electrically alterable ROM 128 at such time that a reduction of power is sensed. In order to insure the complete transfer of data, storage capacitors may be connected in conventional manner to store adequate power to insure the proper functioning of the circuit until the transfer of data has been effected.

Figure 9:
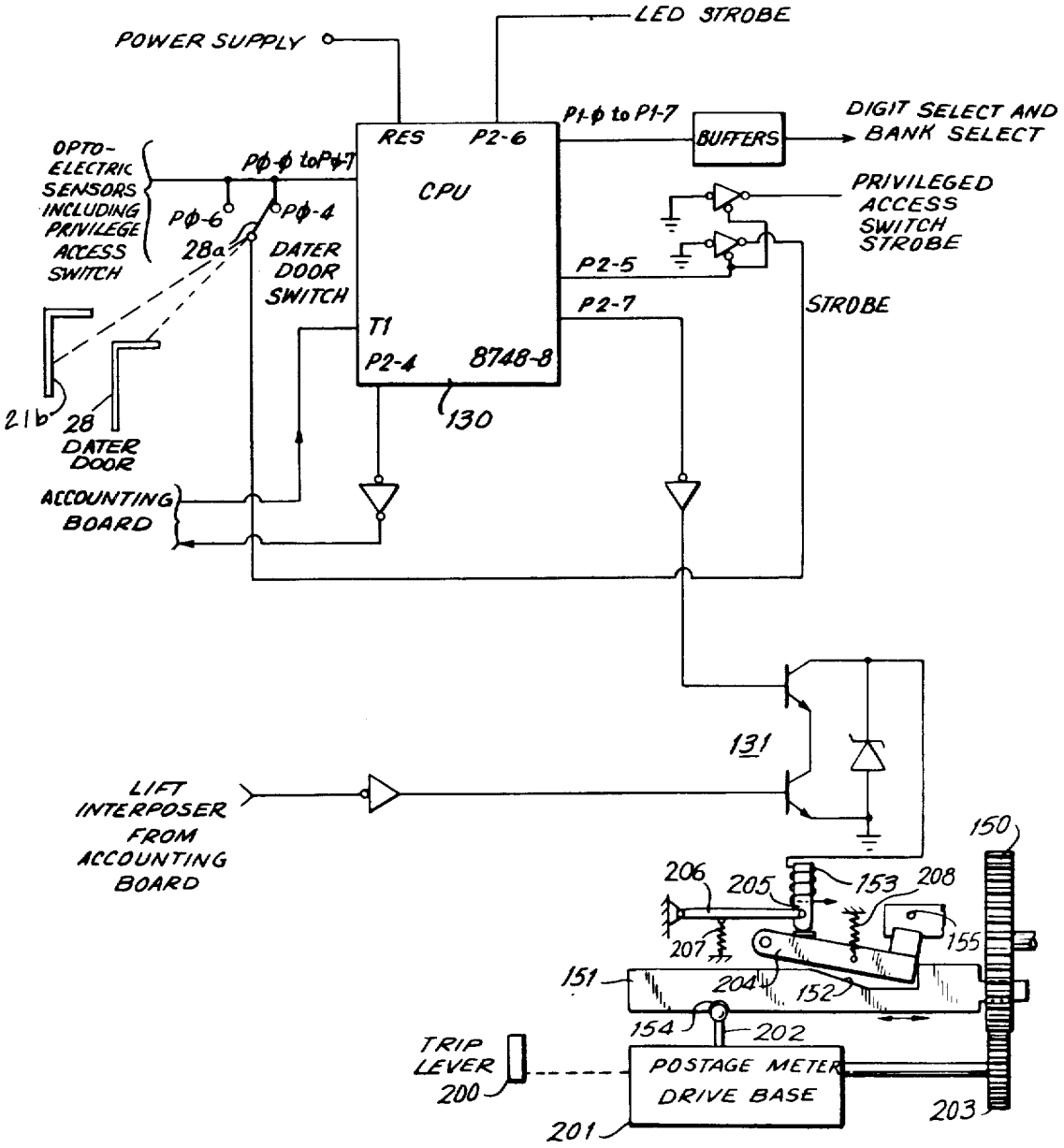
FIG. 9 is a block diagram of a preferred embodiment of the electrical system of the printing unit of a postal meter in accordance with the invention.

A preferred example of the circuit of the printing unit is illustrated in FIG. 9, this circuit consisting primarily of the CPU 130, for example, a type 8748-8, the CPU being connected by way of suitable buffers where necessary, to the I/O devices within the printing unit itself. The mechanical and opto-electric sensing systems in the printing unit are conventional and may be generally of the type disclosed, for example, in U.S. Pat. No. 4,050,374 entitled METER SETTING MECHANISM issued on Sept. 27, 1977 to F. Check, Jr. and aforementioned U.S. Pat. No. 4,253,015, the disclosures of which are specifically incorporated herein by reference. Thus, the CPU is connected to a plurality of opto-electric sensors (not shown) for sensing of the positioning of the print wheels, these lines also being connected to enable the sensing of the privileged access switch 51 of FIG. 2. The privileged access switch 51 is located within the printing unit and is accessible only by way of a door sealed by the post office. These lines of the CPU are further connected to sense the position of the dater door, the dater door switch and privileged access switch being strobed by way of a further output of the CPU 130. The LEDs for the optical sensors are strobed at the proper times by way of another output of the CPU 130, and still further outputs of the CPU enable the stepping of the bank and digit stepping motors for the print wheels. In addition, the CPU 130 has a pair of ports for serially communicating to and from the accounting unit. Further, the interposer output from the accounting unit, and another output of the CPU 130 control a pair of transistors 131 for energizing the interposer solenoid, whereby the interposer solenoid 153 is not energized until all the preconditions are met both in the accounting unit and the printing unit. As a result, a printing cycle cannot commence unless the physical and electrical conditions in the meter are correct for normal printing. In the printing unit, it is therefore evident that the program is provided within the CPU itself.

Postal meters of the above-described form may be provided with several modifications. For example, in one modification, a remote charging feature is available whereby the key is provided for operation of the three-position charging switch on the keyboard. The operator of the unit may thus be provided with suitable combination for entry into the keyboard, to enable remote charging (i.e., away from the post office). In such units the privileged access switch is omitted.

In a further modification, the three-position recharging switch on the keyboard may be controlled by a simple knob, without the necessity of a key. In this type of a system the meter may be manually recharged at the post office, but the service functions may be effected locally in a manner similar to that of remote recharging type units.

In other words, recharging of a postal meter of the above type can be effected locally, if devices are provided with a key for the three-position switch, in which event further security is required as will be discussed later. On the other hand, in postal meters having a simple knob switch instead of the key switch, the "privileged access", sealed at the post office, is provided for manual recharging.

In the normal mode of operation of the system, as above discussed, the six display keys, when depressed, effect the display on the display panel of the six parameters above noted, i.e., the total in the ascending register of all postage that has been printed, the total remaining in the descending register of postage available, the control sum, the total number of printing operations of the meter, the value of postage printed and the number of pieces that have been printed since the last batch clear operation of the associated registers. The depression of these keys results only in the number of concern being displayed for a timed period after the key is released, for example, two seconds following which the display will return to the postage setting.

In either type of meter, if the service switch is placed in the service position, with the three-position switch still in the operate position, the display function of the display keys will be different. Thus, depression of the "postage used" key 35 will now result in a display of the current value set in the dollar unlock register in the machine, at or above which an operator cannot print postage. Postage values above this value require an additional depression of the set postage key for operation, in order to avoid accidental printing of excessive postage values. Depression of the "postage unused" key 36 will now result in a display of the value in the low postage warning register at which a warning should be given that the contents of the descending register are below a determined amount. Depression of the control or "postage sum" key 37, will not result in the display of the serial number of the postal meter. Depression of the "piece count" key 38 will now result in a display of the diagnostic status of the meter. This display provides an indication to the serviceman of possible misfunctions. A depression of the "batch value" key 39 will now result in a display of the maximum settable amount, i.e., the maximum amount set internally within the meter, above which the meter cannot set the print registers. Depression of the "batch count" key 40 will have no effect in the service mode.

The three-position switch is used to effect recharging of the meter or to effect the change of values in the registers concerned with dollar unlock value, the low postage warning amount and the maximum settable amount.

With the remote recharging feature, positioning the three-position switch in either the "enter combination" or "enter amount" positions enables the customer to enter combination or amount respectively into the meter via the keyboard with indication on the display. Leaving the position enters the display value into the accounting unit and blanks the display for the next entry. Return of the three-position switch to the operate position will cause the accounting unit to complete the recharging routine and return the meter to normal usage with the recharging amount added to the postage unused register. The combination for the remote recharging feature is obtained from a data center and is a random or pseudorandom number which changes with each recharging for security reasons.

For meters with the manual recharging feature, the recharging mode is effected by breaking the seal of the privileged access door, and flipping of the privileged access switch. The same sequence of operations of the three-position switch described above for recharging the meter are followed as in those meters having the remote charging feature. In the manual recharging machine only post office personnel are permitted to effect the change. The combination is a fixed number known only to the post office and is stored within the meter. Normal operation of the meter may proceed once the privileged access switch has been returned to its operate position.

To change values in the registers concerned with dollar unlock value, the low postage warning amount and the maximum settable amount the serviceman would place the meter in the service mode by placing the service switch in the service position. The three-position switch is used as described above for the entry of combination and amount values. The meter will interpret the combination value to indicate which register is to be changed.

For the remote recharging meter and the manual recharging meter if an error has been made in entry, the occurrence of this error will be counted, as constituting evidence of tampering with the machine. When a determined number of such errors have ben made, for example, 9, since the last setting of the meter, then the function of the machine in recharging postage will be inhibited. The return of the meter to operating status in such circumstances may be effected at the post office. A discussion of the means to return the meter to operating status is not of consequence to the present invention and relates to the security of the meter.

As above discussed, each of the three units of the postal meter has a microprocessor with a read-only memory defining a given program, and the communication between the units is effected serially and asynchronously. This is achieved in the first place by providing each of the computer systems with a crystal controlled clock. Further, the signals are defined such that the transitions thereof are closely controlled, whereby it is insured that, if a signal is present, it must be present within a given time period. As a still further insurance of the correctness of communication, the bits of a signal are returned to a transmitter as soon as they are received, for error checking at the transmitter, whereby a "no error" bit may be transmitted immediately following a data message if the data has followed correctly.

The program of the control unit responds to the status of the postal meter with respect to determined parameters. A register in the microprocessor of the accounting unit holds meter status information, for example, of two bytes, the bits of which digitally indicate if the meter trip mechanism requires recocking, if the dater door has not been opened following the last application of power or is presently open, if there are insufficient funds to allow printing of the amount set in the print wheels, if the low postage value has been reached, if the meter is in a service mode, if the meter is enabled, if the batch registers are clear, if a trip has been completed, or if various types of errors have occurred. The status message associated with these bits is not the same as the diagnostic message noted above that is employed in the service mode. The accounting unit keeps the control unit informed of the current status by transmitting status message to the control unit after power has been turned on and, thereafter, whenever a change in status occurs, the control unit responds to all such messages by insuring that the display on the meter is consistent with the status message as above discussed. These later steps may include, for example, the display of a row of chemicals in the event of certain errors, the flashing of the decimals point in the event of low postage funds, the flashing of the entire display in the event of insufficient postage, the displaying of underscores in the place of blanks if the meter is in the service mode.

An interrupt program in the control unit interrupts the main program of the control unit at regular intervals in order to scan the keyboard and keyswitch, and to drive the display of the control unit 75 and also the serial channel 88 to which the remote keyboard and display is connected. In order to prevent the display of spurious characters which can be produced by sneak currents when more than one key is pressed, the interrupt program will cause the display to go blank instead. Such values as relate to time, keyboard, and keyswitch are maintained by the interrupt program for use by the main controller program.

The main program for the control unit includes the initializing steps, program steps for the transfer of messages back and forth between the accounting unit and external devices, and control of the timed display, the checking of the status message to insure that dater door and reset base lights are lit in accordance with the status, responding to the reported positions of keys, and three-position switch to ascertain changes of state therein so that the control unit subroutine which corresponds to the function defined for such a state or change of state will be executed.

The program of the accounting unit includes initialization procedures to insure that the working registers are brought up to date, and that no postage has been printed that has not been accounted for, as well as a power down processing program to effect the transfer of data to the nonvolatile (electrically alterable) memory in the event that the power is shut down or is failing.

The main program of the accounting unit effects the transmission of the meter status message to the control unit upon request or change in status, determines the effect of any currently entered postage value on the funding data currently registered and makes any necessary variations in the status message. The main program also controls the timing in the accounting unit for receiving messages from the control unit and the printer. The accounting unit program further includes subroutines for processing of signals in the bringing of the registers up to date when postage is to be printed, and for controlling the operation of the system when the meter is tripped. A further subroutine controls the bringing of the meter status message up to date. In addition an error checking routine which involves cyclical redundancy checking is programmed in the accounting unit software. This will be described in further detail below.

The program of the printer unit includes a main program having initializing steps, steps for scanning the sensors and controlling the strobes for the LEDs of the sensors, and the processing of messages for communication with the accounting system. Subroutines are provided for the setting of the postage wheels, to determine if sensor readings are proper, and to determine if any changes have been made in the outputs of the various hardware sensors and switches such as the privileged access and the dater door switch.

In the normal operation of a postal meter, the meter will be turned off at night. Further, when power is turned on (usually in the morning) in accordance with the invention it is assumed that personnel in operating the machine will have correctly set the date if the dater door is opened and then closed. Under these assumptions, if the dater door is opened and closed following the application of power thereto, it is assumed that the correct date of the printing of the postage will be provided. The program for the postal meter thereby includes, in the meter status message, a meter status bit dependent upon the scanning of the dater door. This bit is on if the dater door is open or the door has not been opened and closed following the last power shut down. If this bit is on, the outer door warning light 41 is energized in the control unit. It is noted that, since the dater door is physically associated with the printing unit, the scanning of the switch associated with the door position is effected by the program of the printing unit CPU. Changes in the status of the dater door switch are automatically transmitted to the accounting unit for updating the meter status message. If the dater door has not been opened and closed following a power up procedure, the control unit program, during the initialization procedure, will note this in the initialization steps, so that the meter will not be enabled and the dater door lamp will remain lit (or in the blinking state). The meter will thereby not be enabled to print postage until the dater door has been opened and closed.

After the dater door has been opened, the date properly set and the dater door closed a user may turn the meter off via switch 19 without opening hood 21*a*. This may be done during temporary breaks, as for example for lunch, or due to intermitten use during the day. In such cases the check data can be turned off after of the meter is again turned on via the remote keyboard and display panel if the dater door is closed. If the dater door is closed and the meter turned on, actuation of check date override key 53 will cause the meter status bit associated with the dater door to be turned off. This is achieved by a signal transmitted from the remote keyboard and display panel via the control unit 75 to the accounting unit. Thus, the accounting unit receives communications regarding the dater door from both the printer module and the control module depending on how the user operates the meter. Should it be desired, key 53 may be eliminated and another key on the keyboard used as a dual purpose key replacing key 53.

Switch 28*a* can also be linked to the operation of the hood 21*b*. Alternatively, a switch, not shown, can be connected in parallel with switch 28*a* and operate in a similar manner to switch 28*a*. With these arrangements, the opening and closing of the hood 21*b* will turn off the check date warning light and also will prevent the meter from operating when the hood is open.

The method by which the CPU 130 in the printer module FIG. 9 disables the meter will now be described. If the dater door is open or until confirmation of the dater door being opened and then closed is received, a high signal from port P2-7 turns off transistor switch 131 de-energizing interposer solenoid 153. If the dater door is closed, however, and key 53 actuated (or similar key 53*a* on control unit 75 actuated), the accounting unit will cause the printing unit CPU provide a low output signal at port P2-7 to cause the upper transistor of transistor pair 131 to be biased for conducion. This allows the interposer solenoid 153 to be energized if the lower transistor of transistor pair 131 is also biased for conduction by the signal from the accounting nodule. Accounting unit redundantly also controls solenoid 153 via the other transistor of transistor pair 131. This in turn prevents postage meter operation as follows:

Referring again to FIG. 9, the driving gear 150 of the postal meter, which is mechanically coupled to the printing drum, is positioned in conventional manner to be driven by the output gear 203 of the drive base 201 in a conventional manner. The drive base has a shutter lever 202 engaging a notch 154 in the shutter 151 of the postal meter, the shutter 151 being movable into and out of locking engagement with the driving gear 150. The shutter 151 is provided with a further notch 152 positioned to receive a pivoted lever or interposer 204 in the lock position of the postal meter, i.e., when the shutter blocks movement of the gear 150. A lever 206 having a fixed pivot at one end, is pivoted at its other end to the core 205 of a solenoid 153, the free end of the solenoid engaging the interposer 204. A spring 207 affixed to the lever 206 urges the core 205 against the interposer in such a direction as to urge the interposer into the notch 152 when the solenoid is de-energized and the notch is aligned therewith. This portion of the system is further provided with a light sensor device 155 positioned to provide a signal to the circuit 130 indicating whether or not the interposer is in interlocking position in the notch 152 of the shutter. The solenoid core is not mechanically held to the interposer, so that upon energization, the core of the solenoid will not itself effect the withdrawal of the interposer from the notch. A light spring 208 is therefore connected to the interposer, with a sense to pull it from the notch unless the shutter is jammed against the interposer. The spring 208, of course, does not have adequate strength to withdraw the interposer from the notch against the opposite directed force of the spring 207 when the solenoid is de-energized. The reference numeral 200 depicts the trip lever of the drive. The sensor 155, which may be an LED sensor, may be strobed by the output of the circuit 130 in turn as are the other optical sensing devices in the printing unit. It is thus apparent that, conduction of the transistors 131, the solenoid 153 is energized to cause the interposer to be released from the shutter, thereby enabling withdrawal of the shutter from the driving gear 150 under the control of the shutter lever 202 of the drive base, in the conventional manner. Although a notch 152, utilized as a retaining means, is shown, it will be understood that a laterally extending tab may also be employed. Further, the pivot on lever 206 is not essential in that a linear movement can be imparted to the lever 206 to catch the shutter 151. Other variations may also be employed. Systems of this type are disclosed, for example, in aforementioned U.S. Pat. No. 4,253,015 assigned to the assignee of the present application, and also in copending application Ser. No. 89,412 filed Oct. 30, 1979, for a "Print Control System", by A. Eckert, R. Malin, R. McFiggans and L. Pengue, and assigned to the assignee of the present application.

Each of the transistors of series pair 131 must be rendered conductive in order for the solenoid to be energized. As described above, the transistors each respond to separate input systems, in the respective separate microprocessors, which have coordinated activity as a result of an exchange of messages regarding the status of the different portions of the meter.

As a consequence, when a fault or other condition occurs that renders it undesirable for the meter to print postage, and this condition is determined in one of the controlling systems, this controlling system renders or maintains its associated transistor non-conductive, and signals the other controlling system to likewise render or maintain its transistor non-conductive. It is thus apparent that faults in either of the transistor, as well as certain faults in the controlling systems will not result in the erroneous printing of postage.

In operation, in accordance with the invention, it is therefore apparent that printing operations in the meter are blocked by the operational state of the dater door switch under two conditions. In the first condition, i.e., with the dater door switch open, operation of the postage meter is prevented in all circumstances. This prevents, for example, any possibility of injury to the meter or personnel that may occur from moving parts that may be exposed if the dater door is opened. Further, in accordance with the invention, the status of the dater door switch prevents operation of the postal meter until the dater door has been opened and closed at least once during the initialization of the postage meter following an application of power thereto unless switch 53 on the remote keyboard and display or the similar key **53*a* on control unit 75 is actuated. In both instances, the check dater door LED is energized, preferably to provide a blinking indication, so that the operator will then know to either: open hood 21*a* and close the door; or open the door, reset the date, and then close the door; or actuate key 53 on the remote keyboard and display panel; or open hood 21*a* and actuate the corresponding key 53*a* on the control unit 75 or open and close hood 21*a***.

The condition of the dater door switch is thereby continually monitored, in the printing unit, and any changes in the condition of this description are communicated by message to the accounting unit for updating of the meter status message. The control unit, which receives any information concerning changes in the meter status message, thereby controls energization of the check dater door light when necessary. Moreover, the remote keyboard can communicate a signal via the control unit to the accounting unit to update to meter status message without opening the hood. The accounting unit then controls the printing unit CPU to energize the interposer solenoid.

It will of course be apparent that the features of the present invention may be incorporated in other postage meters than the three separate unit type herein disclosed, since the invention is not dependent upon this feature for novelty.

Figure 10:
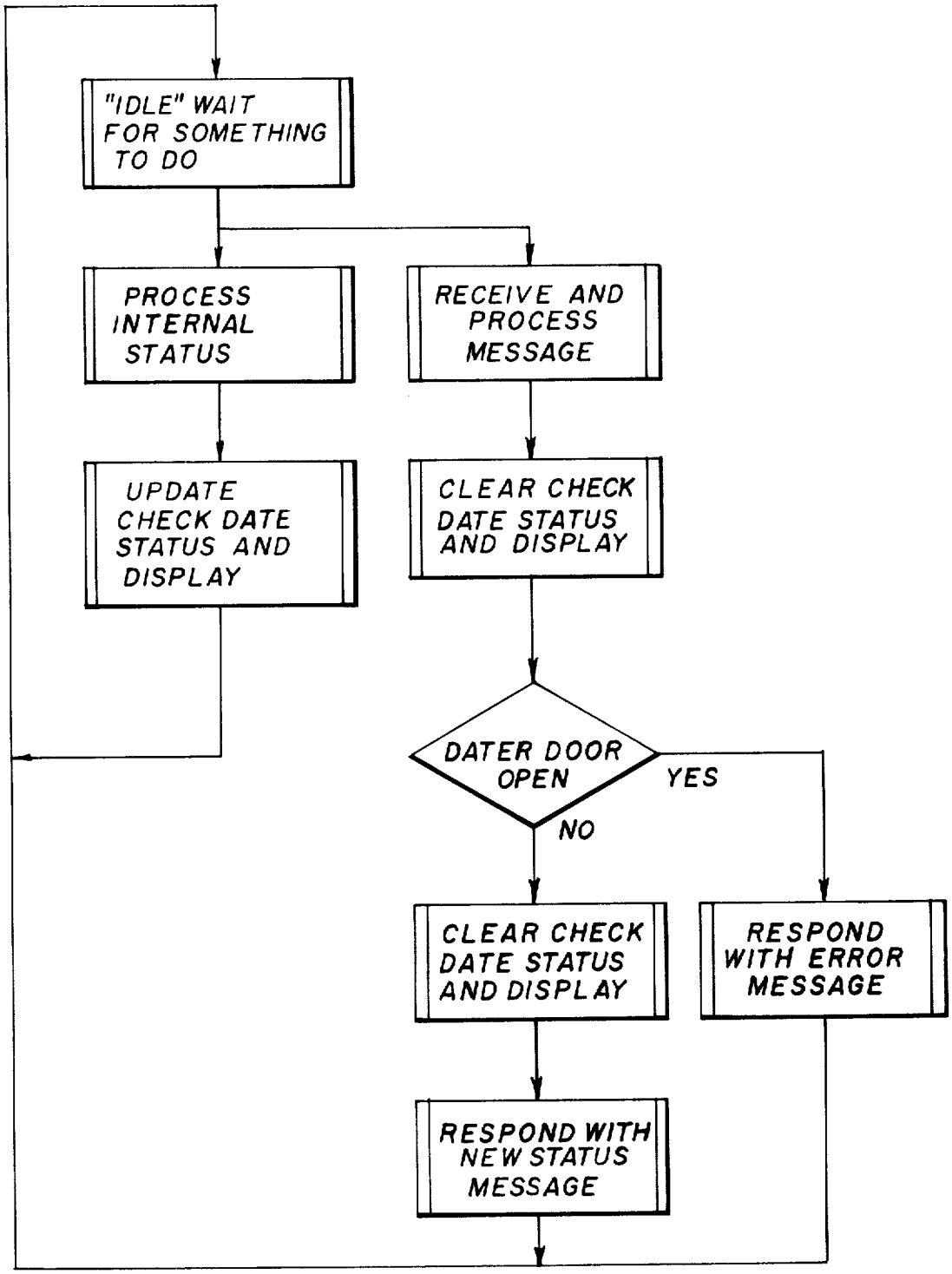
FIG. 10 is a flow chart of the operation of a portion of the postal meter in accordance with an embodiment of the present invention.

A complete flow chart of the software functions of the accounting, control and printing units is shown in greater detail in copending patent application Ser. No. 89,413, filed Oct. 30, 1979, now U.S. Pat. No. 4,301,507, issued Nov. 17, 1981 for ELECTRONIC POSTAGE METER HAVING PLURAL COMPUTING SYSTEMS and assigned to the assignee of the present invention. The flow chart for the operation of the postage meter in accordance with the present invention is shown in FIG. 10 and is additional and supplemental to the flow charts shown in the U.S. Pat. No. 4,301,507. In addition, a complete printout of the programs actually contained within the permanent memory of each microprocessor in each of the accounting, control and printing units, respectively is disclosed therein. That disclosure is specifically incorporated by reference in this application.

Variations and modifications in the different functions performed by the operation of the apparatus of the present invention can be effected in accordance with changes in the various programs previously set in memory. Moreover, the system can be modified to provide a separate and independent switch operated by the hood 21*a* which is separately connected to the system and which cannot be overriden by means of key 53 or 53*a*. With such an arrangement, the hood would have to be opened and closed before the meter can be operated or only be closed for enabling meter operation. This feature can be used with or without the use of a dater door switch.

It is known and understood that the terms postage meter and postal meter, as used herein, refer to the general definition of a device for the imprinting of a defined unit value for governmental or private carrier parcel, envelope or package delivery, or other like application for unit value printing. Thus, although the term postal meter is utilized, it is both known and employed in the trade as a general term for devices utilized in conjunction with services other than those exclusively employed by governmental postal services. For example, private parcel or freight services purchase and employ postal meters as a means to provide unit value pricing for individual parcels, including accounting and printing functions.

The present invention is particularly directed to use in a postal meter which will employ varying features and functions, described in differing aspects, in any one or more of the following groups of pending patent applications, all filed on Oct. 30, 1979: Ser. No. 89,424 to Jones, et al, for "POSTAGE METER HAVING INTERACTIVE ARITHMETIC OPERATION CAPABILITY", now U.S. Pat. No. 4,280,179, issued July 21, 1981; Ser. No. 89,425 to Eckert, et al, for "POSTAGE METER HAVING FIELD RESETTABLE CONTROL VALUES", now U.S. Pat. No. 4,280,180, issued July 21, 1981; Ser. No. 89,426 to Eckert, et al, for "ELECTRONIC POSTAGE METER HAVING KEYBOARD ENTERED COMBINATION FOR RECHARGING"; Ser. No. 89,427 to Eckert, et al, for "ELECTRONIC POSTAGE METER HAVING RESET BASE WARNING", now U.S. Pat. No. 4,266,222, issued May 5, 1981; Ser. No. 89,434 to Muller for "ELECTRONIC POSTAGE METER OPERATING VOLTAGE VARIATION SENSING SYSTEM", now U.S. Pat. No. 4,285,050, issued Aug. 18, 1981; Ser. No. 89,412 to Eckert, et al, for "PRINT CONTROL SYSTEM", now U.S. Pat. No. 4,287,825, issued Sept. 8, 1981; Ser. No. 89,413 to Soderberg, et al, for "ELECTRONIC POSTAGE METER HAVING PLURAL COMPUTING SYSTEMS", now U.S. Pat. No. 4,301,507, issued Nov. 17, 1981; Ser. No. 89,411 to Eckert, et al, for "INTERPOSER CONTROL FOR ELECTRONIC POSTAGE METER", now U.S. Pat. No. 4,302,821, issued Nov. 24, 1981.

While this invention has been disclosed and described with reference to a simple embodiment thereof, it will be apparent that variations and modifications may be made therein, and it is intended in the following claims to cover each such variation and modification as falls within the true spirit and scope of the invention.

What is claimed is:

1. In an electronic postal meter having a postage printing device and a computer means and further including date setting means and an access door enabling external access to date setting means; the improvement comprising switch means connected to said door for signaling the position thereof to said computer means, a warning indicator coupled to said computer means for indicating that said door is opened, said computer means having an operating power input and means responsive to application of power to said meter for inhibiting operation of said meter until said access door has been opened and closed at least once and means coupled to said computer means for enabling operation of said meter when said door is closed and operable such that said meter can be enabled for operation without opening and closing said door.

2. An electronic postal meter as defined in claim 1 wherein said means for enabling is located remote from said postal meter.

3. An electronic postal meter as defined in claim 2 wherein said means for enabling comprises a keyboard.

4. In an electronic postage meter connectable to a source of operating potential and having a dater door, a switch coupled to said door for signaling the position of said door, a warning device, and circuit means coupled to said switch and connected to energize said warning device when said door is open; the improvement wherein said circuit means comprises means responsive to connection of said meter to said source for energizing said warning device until said door has been both opened and closed at least once and means coupled to said circuit means for enabling operation of said meter when said door is closed such that said meter can be enabled for operation without opening and closing said door.

5. The postage meter of claim 4, further comprising means for inhibiting said postage meter from printing postage, said inhibiting means being connected to be responsive to said connection of said meter to said source for controlling said meter inhibiting means until said door has been both opened and closed at least once upon connection of said meter to said source or said enabling means is actuated to enable operation of said meter without opening and closing said door.

6. An electronic postage meter as defined in claim 5 wherein said enabling means is located remote from said meter.

7. An electronic postage meter as defined in claim 6 including a second enabling means mounted on said meter for enabling operation of said meter when said door is closed without opening and closing said door such that said meter can be enabled for operation without opening and closing said door.

8. A postage meter as defined in claim 7 wherein said means for enabling comprises a keyboard having a check date warning key.

9. A postage meter as defined in claim 8 wherein said second means for enabling comprises a keyboard having a check date override key.

10. A postage meter as defined in claim 9 wherein said warning device is a visual warning device.

11. A postage meter as defined in claim 9 including a base coupled to drive the postage meter printing means and a hood movably mounted on said base and covering said dater door.

12. A system comprising:

an electronic postal meter having a postage printing device, computer means and including date setting means and an access door enabling external access to said date setting means, switch means connecting to said door for signalling the position thereof to said computer means, a warning indicator coupled to said computer means for indicating that said door is opened, said computer means having an operating power input and means responsive to application of power to said meter for inhibiting operation of said meter until said access door has been opened and closed at least once, means coupled to said computer means for enabling operation of said meter when said door is closed and operable such that said meter can be enabled for operation without opening and closing said door, a base coupled to said postage printing device for providing operating energy for said postage printing device; and a hood movably mounted on said base and covering said door.

* * * * *